US010339794B2

(12) United States Patent
Bajaj et al.

(10) Patent No.: US 10,339,794 B2
(45) Date of Patent: Jul. 2, 2019

(54) SMOKE DETECTOR AND METHOD FOR DETERMINING FAILURE THEREOF

(71) Applicant: Google LLC, Mountain View, CA (US)

(72) Inventors: Kunal Kishore Bajaj, Mountain View, CA (US); Andrii Korchak, Mountain View, CA (US); Jason Rundle Rukes, San Francisco, CA (US)

(73) Assignee: Google LLC, Mountain View, CA (US)

( * ) Notice: Subject to any disclaimer, the term of this patent is extended or adjusted under 35 U.S.C. 154(b) by 7 days.

(21) Appl. No.: 15/416,837

(22) Filed: Jan. 26, 2017

(65) Prior Publication Data

US 2018/0211514 A1 Jul. 26, 2018

(51) Int. Cl.
*G08B 29/14* (2006.01)

(52) U.S. Cl.
CPC ..... *G08B 29/145* (2013.01)

(58) Field of Classification Search
CPC ..... G08B 29/14; G08B 17/06; G08B 29/145; G08B 29/12; G08B 25/14; G08B 29/043
USPC ..... 340/514
See application file for complete search history.

(56) References Cited

U.S. PATENT DOCUMENTS 5,381,130 A 1/1995 Thuillard et al.
5,708,414 A * 1/1998 Peltier ..... G08B 17/107 250/574
5,821,866 A 10/1998 Bernal et al.
2003/0218759 A1* 11/2003 Lee ..... G01J 9/0246 356/519
2005/0173638 A1 8/2005 Powell
2010/0271220 A1* 10/2010 Pattok ..... G08B 3/10 340/628
2014/0233105 A1* 8/2014 Schmeder ..... G01J 3/465 359/590
2015/0187194 A1* 7/2015 Hypolite ..... G08B 7/06 340/628
2017/0094376 A1* 3/2017 Trainor ..... H04Q 9/00
2018/0239171 A1* 8/2018 Wold ..... A61F 9/022

OTHER PUBLICATIONS

Siemens; Aspirating Smoke Detection Very Sensitive and Reliable Fire Detection Through Differentiation Between Smoke and Deceptive Phenomena, White Paper, Jun. 9, 2015, www.siemens.com/asd; 9 pages.

* cited by examiner

*Primary Examiner* — Omer S Khan
(74) *Attorney, Agent, or Firm* — Kilpatrick Townsend & Stockton LLP

(57) ABSTRACT

A smoke detector includes an illuminator, a light sensor, a memory, and a microprocessor. The illuminator is configured to emit a first electromagnetic signal having a first center wavelength and a second electromagnetic signal having a second center wavelength. The light sensor is configured to generate (a) a first clean-air voltage in response to receiving the first electromagnetic signal and (b) a second clean-air voltage in response to receiving the second electromagnetic signal. The memory stores non-transitory computer-readable instructions. The microprocessor is adapted to execute the instructions to: (i) determine a first signal drift value from the first clean-air voltage and a first reference voltage, (ii) determine a second signal drift value from the second clean-air voltage and a second reference voltage, and (iii) determine the operational state from both the first signal drift value and the second signal drift value.

12 Claims, 7 Drawing Sheets

600

| | | | | | | | | | | |
|---|---|---|---|---|---|---|---|---|---|---|
| 0 | 0 | 0 | 0 | 0 | 0 | 0 | 0 | 0 | 0 | 0 |
| 1 | 0 | 0 | 0 | 0 | 0 | 0 | 0 | 0 | 0 | 0 |
| 1 | 1 | 0 | 0 | 0 | 0 | 0 | 0 | 0 | 0 | 0 |
| 1 | 1 | 1 | 0 | 0 | 0 | 0 | 0 | 0 | 0 | 0 |
| 1 | 1 | 1 | 1 | 1 | 0 | 0 | 0 | 0 | 0 | 0 |
| 1 | 1 | 1 | 1 | 1 | 1 | 0 | 0 | 0 | 0 | 0 |
| 1 | 1 | 1 | 1 | 1 | 1 | 1 | 0 | 0 | 0 | 0 |
| 1 | 1 | 1 | 1 | 1 | 1 | 1 | 1 | 0 | 0 | 0 |
| 1 | 1 | 1 | 1 | 1 | 1 | 1 | 1 | 1 | 0 | 0 |
| 1 | 1 | 1 | 1 | 1 | 1 | 1 | 1 | 1 | 0 | 0 |
| 1 | 1 | 1 | 1 | 1 | 1 | 1 | 1 | 1 | 0 | 0 |

502

SMOKE DETECTOR AND METHOD FOR DETERMINING FAILURE THEREOF

BACKGROUND

Photoelectric smoke alarms in residential and commercial buildings include a smoke chamber, a light source, and a photodetector. Proper functioning of such smoke alarms depends in part on the photodetector's response when both (a) smoke is present in and (b) smoke is absent from, the smoke chamber.

SUMMARY OF THE EMBODIMENTS

In one embodiment, a method determines an operational state of a smoke detector having an illuminator and a light sensor. The method includes steps of: (i) measuring a first clean-air voltage, from the light sensor, in response to a first electromagnetic signal emitted by the illuminator, (ii) determining a first signal drift value from the first clean-air voltage and a first reference voltage, (iii) measuring a second clean-air voltage, from the light sensor, in response to a second electromagnetic signal emitted by the illuminator, (iv) determining a second signal drift value from the second clean-air voltage and a second reference voltage, and (v) determining the operational state from both the first signal drift value and the second signal drift value.

In one embodiment, a smoke detector includes an illuminator, a light sensor, a memory, and a microprocessor. The illuminator is configured to emit a first electromagnetic signal having a first center wavelength and a second electromagnetic signal having a second center wavelength. The light sensor is configured to generate (a) a first clean-air voltage in response to receiving the first electromagnetic signal and (b) a second clean-air voltage in response to receiving the second electromagnetic signal. The memory stores non-transitory computer-readable instructions. The microprocessor is adapted to execute the instructions to: (i) determine a first signal drift value from the first clean-air voltage and a first reference voltage, (ii) determine a second signal drift value from the second clean-air voltage and a second reference voltage, and (iii) determine the operational state from both the first signal drift value and the second signal drift value.

DETAILED DESCRIPTION OF THE EMBODIMENTS

Figure 1:
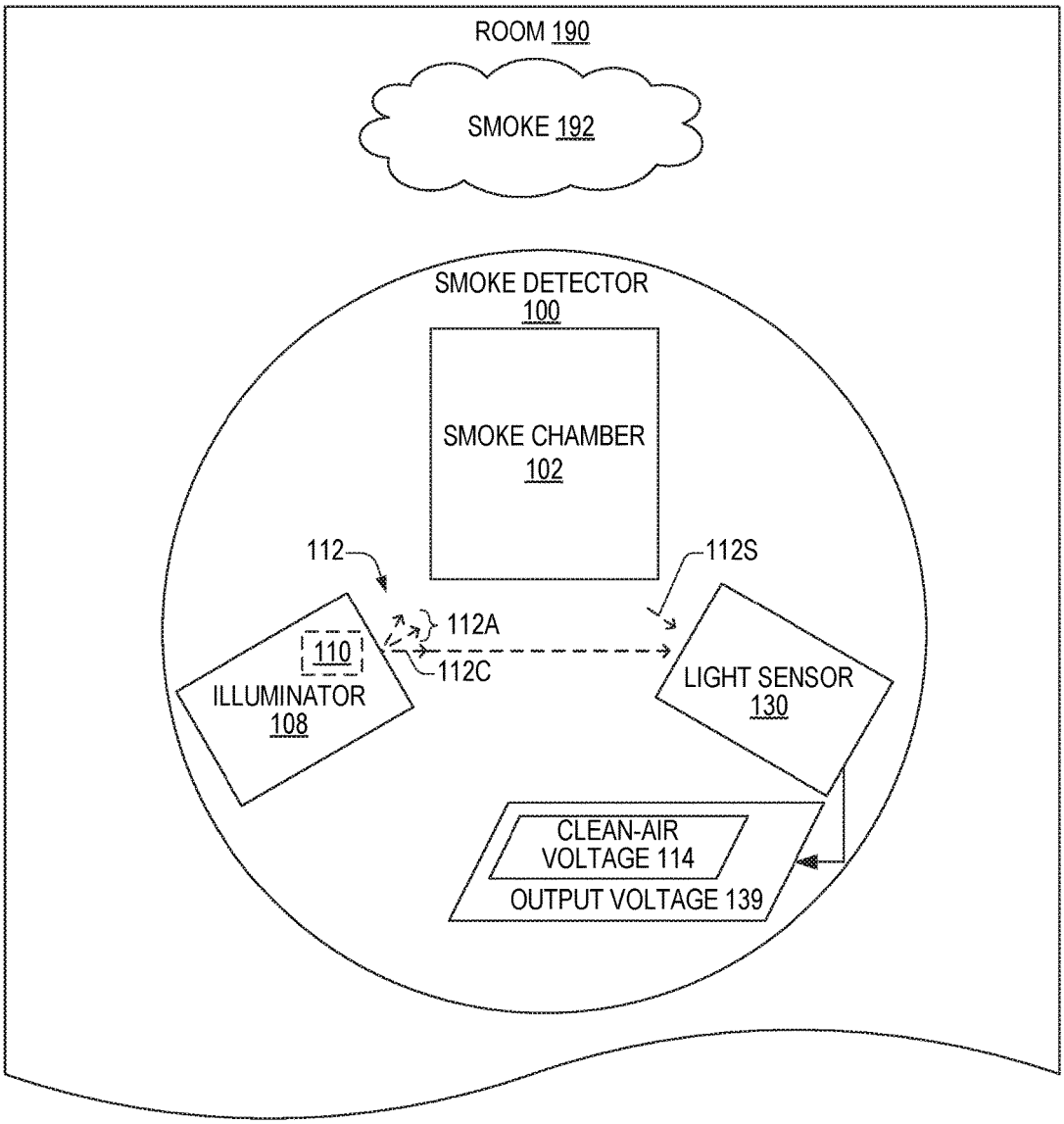
FIG. 1 is a schematic diagram of a smoke detector, in an embodiment.

FIG. 1 is a schematic diagram of a smoke detector 100 in a room 190 that includes smoke 192. Smoke detector 100 includes a smoke chamber 102, an illuminator 108, and a light sensor 130. Illuminator 108 may include one or more light sources 110, which may be a light-emitting diode (LED), laser diode, or other light source known in the art. Light sensor 130 may include one or more photodetectors.

Illuminator 108 emits light 112, which includes light portions 112A and 112C. Light portions 112A and 112C propagate toward smoke chamber 102 and light sensor 130, respectively. Light sensor 130 produces an output voltage 139 in response to detecting light portion 112C. In a "clean-air" condition, when smoke chamber 102 contains no smoke, light sensor 130 detects only light portion 112C and produces a corresponding clean-air current and associated clean-air voltage 114, which is equal to output voltage 139 in a clean-air condition. When smoke 192 is in smoke chamber 102, smoke 192 scatters part of light portion 112A toward light sensor 130, which increases output voltage 139. In a "clean air" state, when smoke chamber 102 contains no smoke, light portion 112A does not reach light sensor 130.

In some embodiments, smoke detector 100 is a photoelectric light scattering smoke detector. In such embodiments, when a portion of smoke 192 enters smoke chamber 102, part of light portion 112A is scattered by smoke 192 in smoke chamber 102 as scattered light 112S, which propagates toward light sensor 130 such that output voltage 139 exceeds clean-air voltage 114. It is envisioned that the spatial arrangement of smoke chamber 102, illuminator 108, and light detector may differ from the arrangement illustrated in FIG. 1. Without departing from the scope hereof, smoke detector 100 may be a photoelectric light obscuration smoke detector, such that output voltage 139 falls below clean-air voltage 114 when smoke is in smoke chamber 102.

Over time, the intensity of light 112 decreases, for example, when illuminator 108 includes an LED. This decreased light intensity results in scattered light 112S being attenuated, and hence a decreased sensitivity of smoke detector 100. When scattered light 112S is attenuated, clean-air voltage 114 is similarly attenuated. Hence, the magnitude of clean-air voltage 114 is indicative of attenuation of scattered light 112S. When clean-air voltage 114 decreases below a threshold clean-air voltage, smoke detector 100 does not reliably detect smoke, and hence is in a degraded or failed operational state. The threshold clean-air voltage is a proxy for a threshold brightness of scattered light 112S. Herein, a failed operational state is an example of a degraded operational state.

Figure 2:
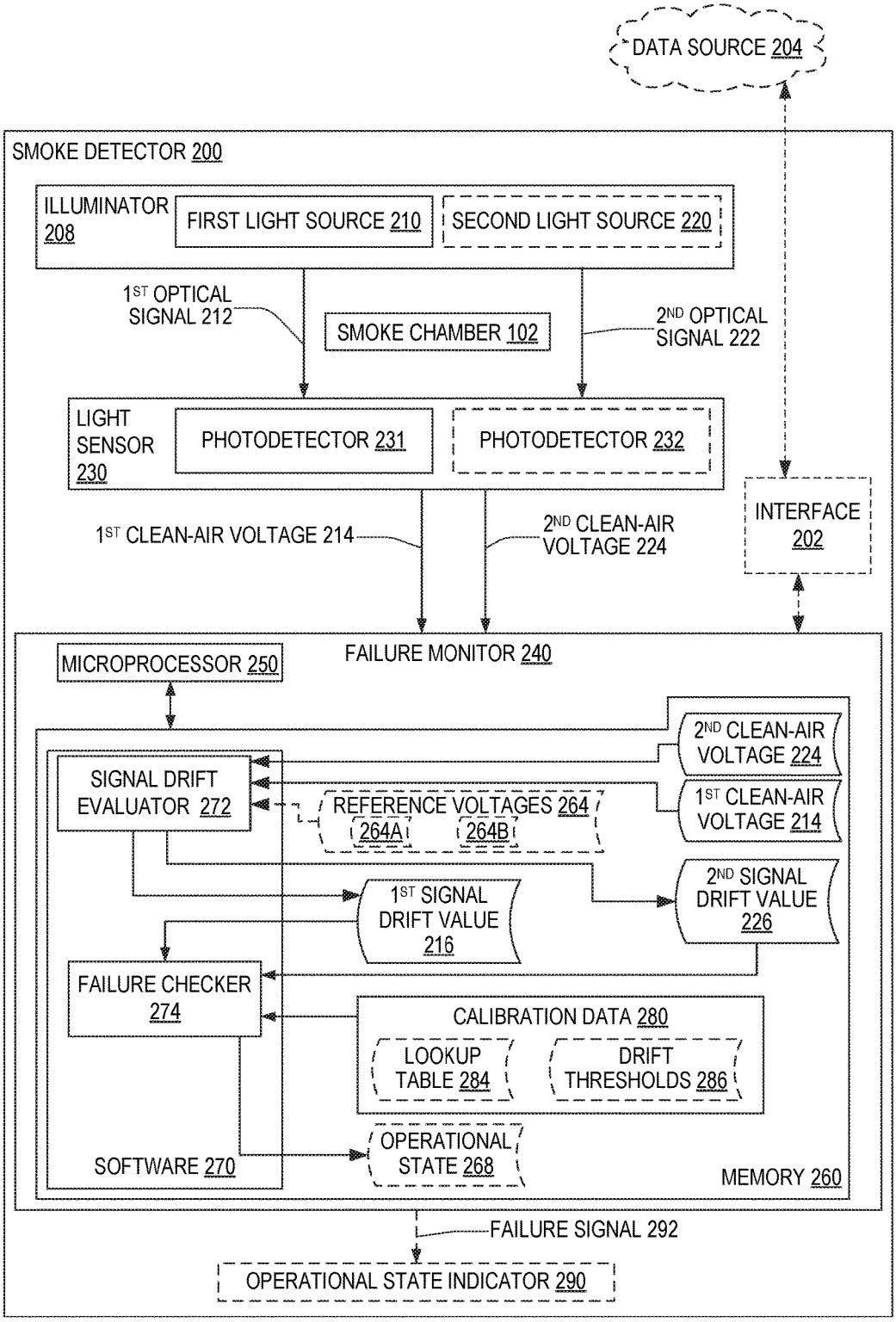
FIG. 2 is a schematic diagram of a smoke detector, which is an example of the smoke detector of FIG. 1.

FIG. 2 is a schematic diagram of a smoke detector 200, which is an example of smoke detector 100, and may utilize smoke detection via at least one of photoelectric light scattering or photoelectric light obscuration. Smoke detector 200 includes illuminator 208, smoke chamber 102, a light sensor 230, and a failure monitor 240. Smoke detector 200 may also include an operational state indicator 290. Illuminator 208 is an example of illuminator 108 and includes a first light source 210. Light sensor 230 is an example of light sensor 130 and includes first photodetector 231. Illuminator 208 may include a second light source 220 and light sensor 230 may include a second photodetector 232. Light sources 210 and 220 are each an example of light source 110.

In embodiments, failure monitor 240 includes a microprocessor 250 and a memory 260, which are communicatively coupled. Failure monitor 240 may be a type of computer. Memory 260 stores software 270, first and second signal drift values 216 and 226, and calibration data 280. Memory 260 may also store reference voltages 264 and operational state 268.

Software 270 includes a signal drift evaluator 272 and a failure checker 274. Memory 260 may be transitory and/or non-transitory and may represent one or both of volatile memory (e.g., SRAM, DRAM, computational RAM, other volatile memory, or any combination thereof) and non-volatile memory (e.g., FLASH, ROM, magnetic media, optical media, other non-volatile memory, or any combination thereof). Part or all of memory 260 may be integrated into microprocessor 250.

The size of particles constituting smoke 192 depends on its source, that is, the type of process that produces smoke 192. Illuminator 208 may be configured to emit more than one wavelength of light into smoke chamber 102, which enables detection of, and differentiation of, types of smoke that differ in particle size. In an example mode of operation, first light source 210 emits a first optical signal 212 having a first center wavelength $\lambda_1$. Illuminator 208, e.g., via second light source 220, emits a second optical signal 222 having a second center wavelength $\lambda_2$.

In embodiments, second center wavelength $\lambda_2$ exceeds the first center wavelength by at least twenty percent of first center wavelength $\lambda_1$. For example, light source 210 emits blue light and light source 220 emits near-infrared (near-IR) light such that $\lambda_1$ is between 0.40 μm and 0.48 μm and $\lambda_2$ is between 0.66 μm and 1.0 μm. At least one of first center wavelength $\lambda_1$ and second center wavelength $\lambda_2$ may be outside of the optical portion of the electromagnetic spectrum without departing from the scope hereof. For example, first center wavelength $\lambda_1$ may be shorter than 0.40 μm and second center wavelength $\lambda_2$ may exceed 1.0 μm.

In an embodiment of smoke detector 200 that includes both second light source 220 and second photodetector 232, first photodetector 231 is configured to detect first center wavelength $\lambda_1$ and second photodetector 232 is configured to detect second center wavelength $\lambda_2$. For example, first photodetector 231 includes a bandpass filter that transmits first center wavelength $\lambda_1$ and blocks second center wavelength $\lambda_2$, while second photodetector 232 includes a bandpass filter that transmits second center wavelength $\lambda_2$ and blocks first center wavelength $\lambda_1$. Photodetectors 231 and 232 may have respective spectral response curves optimized for first center wavelength $\lambda_1$ and second center wavelength $\lambda_2$, respectively.

Light sensor 230 is configured to produce respective clean-air voltages 214 and 224 in response to first and second optical signals 212 and 222. Memory 260 stores clean-air voltages 214 and 224. Reference voltages 264 may include initial clean-air voltages 264A and 264B, which, for example, respectively correspond to initial values of clean-air voltages 214 and 224 before any use-related decrease of optical signals 212 and 222.

In an embodiment, signal drift evaluator 272 is configured to receive first clean-air voltage 214 to generate therefrom a first signal drift value 216. In an embodiment, signal drift evaluator 272 is configured to receive first clean-air voltage 214 and reference voltage 264A to generate therefrom a first signal drift value 216. In an embodiment, signal drift evaluator 272 is configured to receive second clean-air voltage 224 to generate therefrom a second signal drift value 226. In an embodiment, signal drift evaluator 272 is configured to receive second clean-air voltage 224 and reference voltages 264, e.g., reference voltage 264B, to generate therefrom a second signal drift value 226.

Failure checker 274 may be configured to receive first signal drift value 216 and second signal drift value 226 and calibration data 280 to generate therefrom operational state 268. Operational state 268 is, for example, one of two values that indicate either a functioning or degraded operational state. Failure monitor 240 may generate a failure signal 292 indicating operational state 268 via operational state indicator 290. Operational state indicator 290 may be one of a light, a sound, and a combination thereof.

Smoke detector 200 may include a network interface 202 that communicatively couples failure monitor 240 to a remote data source 204. Remote data source 204 is a server, for example. Remote data source 204 may provide failure monitor 240 with updated versions of at least one of reference voltages 264, calibration data 280, signal drift evaluator 272, and failure checker 274. Interface 202 is, for example, a network interface such that remote data source 204 and failure monitor 240 communicate via a wired communication channel, a wireless communication channel, or a combination thereof. In an embodiment, remote data source 204 includes at least part of failure monitor 240, such that at least part of failure monitor 240 is remotely located from illuminator 208 and light sensor 230.

Figure 3:
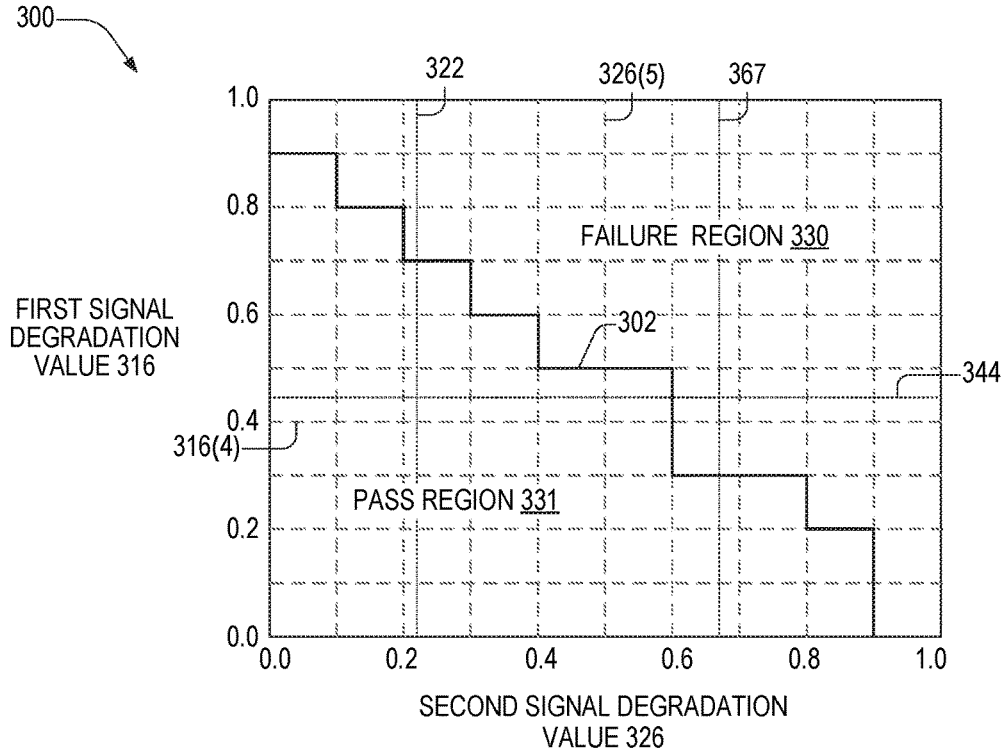
FIG. 3 illustrates a first smoke detector failure map stored in a memory of the smoke detector of FIG. 2, in an embodiment.

FIG. 3 discloses a failure map 300, which is an example of a smoke detector failure map. Failure map 300 indicates a pass region 331 and a failure region 330 determined by a plurality of first signal degradation values 316 and a plurality of second signal degradation values 326. Regions 331 and 330 have a boundary 302 therebetween. Signal degradation values 316 and 326 are examples of drift values 216 and 226, respectively, and indicate degradation of first and second clean-air voltages 214 and 224, respectively. For example, when second signal degradation value 326 equals 0.22, second clean-air voltage 224 is seventy-eight percent of reference voltage 264B. In the following description, boundary 302 is part of failure region 330 such that, for example, when second signal degradation value 326 equals 0.22, any value of first signal degradation value 316 in failure region 330 greater than or equal to 0.7 is in failure region 330. Alternatively, boundary 302 may be part of pass region 331 without departing from the scope hereof.

Failure map 300 may be generated by empirically testing one or more smoke detectors 200 with a plurality of combinations of clean-air voltages 214 and 224, where each combination corresponds to a predetermined pair of signal degradation values 316 and 326. For example, the predetermined signal degradation values 316 are signal degradation values 316(0-$N_1$) and the predetermined signal degradation values 326 are signal degradation values 326(0-$N_2$). In failure map 300, integer $N_1$=$N_2$=10 such that drift values range from zero to one in increments of one-tenth. Integers $N_1$ and $N_2$ may be less than or exceed ten without departing from the scope hereof.

Pass region 331 also denotes selected pairs of signal degradation values 316, 326 corresponding to when smoke detector 200 functions properly, e.g., by accurately detecting presence of smoke according to a predetermined sensitivity. For example, at second signal degradation value 326(5), smoke detector 200 functions properly when first signal degradation value 316 is less than 0.5, such as first signal degradation value 316(4), which equals 0.4. At second signal degradation value 326(5), smoke detector 200 does not function properly when first signal degradation value 316 exceeds 0.5.

Figure 4:
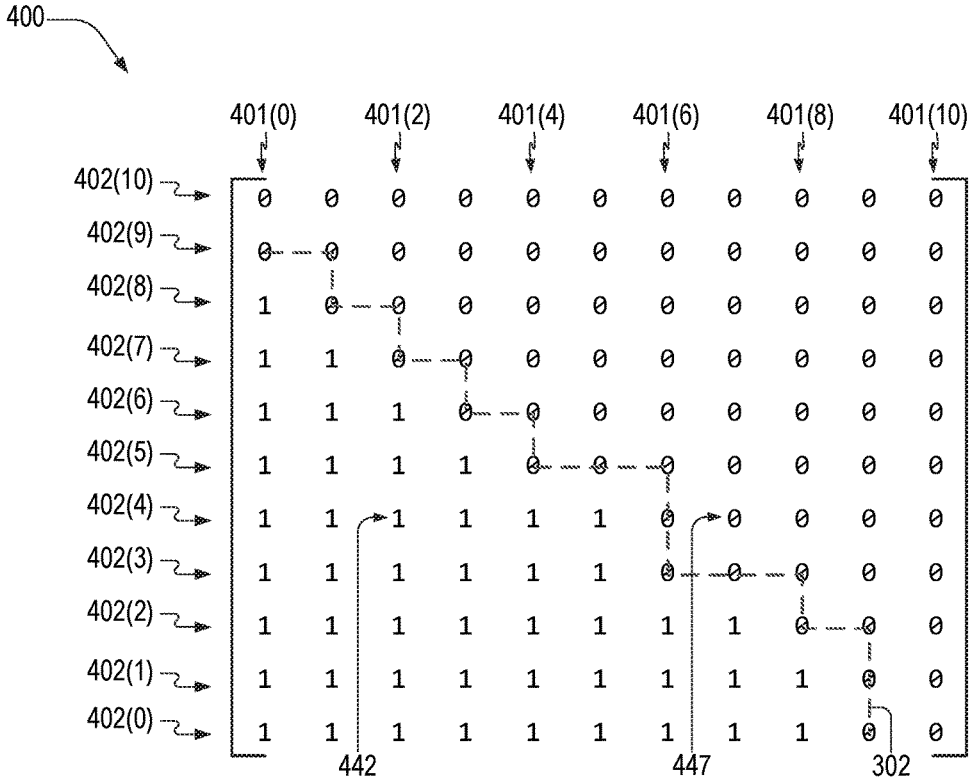
FIG. 4 illustrates a first example of a lookup table representing the failure map of FIG. 3.

Failure map 300 is an example of calibration data 280 and may be stored as a lookup table 284 thereof. FIG. 4 illustrates an example lookup table 400 representing failure map 300 when integers $N_1$ and $N_2$ both equal ten. Lookup table 400 is an example of lookup table 284. Lookup table 400 is an eleven-by-eleven array of integers that indicate proper functioning (integer equals one) and failure (integer equals zero) of smoke detector 200 corresponding to signal degradation values 316(0-$N_1$) and 326(0-$N_2$). Lookup table 400 has eleven columns 401(0-10) corresponding to second signal degradation values 326(0-10), respectively, and eleven rows 402(0-10) corresponding to first signal degradation values 316(0-10), respectively.

Boundary 302 is superimposed on lookup table 400 to denote the boundary between ones and zeros. In the example of lookup table 400, lookup table values corresponding to boundary 302 equal zero. One or more lookup table values corresponding to boundary 302 may equal one without departing from the scope hereof.

Whereas elements of lookup table 400 are integers, lookup table 400 may include floating-point values without departing from the scope hereof. For example, elements of lookup table 400 may range between a maximum value and a minimum value. The value of an element compared to a threshold value between the maximum and minimum value determines whether smoke detector 200 is properly functioning or in a failure state. For example, elements of lookup table have floating-point values between zero and one, where values less than 0.6 denote failure.

Failure map 300 may be stored as a plurality of drift thresholds 286 of calibration data 280. For example, boundary 302 may be fit to a function b(x), where x is a second signal degradation value 326 and b(x) is a corresponding first signal degradation value 316. Function b(x) may be a monotonically non-increasing function of increasing x, shown in FIG. 3 as boundary 302. Function b(x) is, for example, a polynomial function or a piecewise function.

Figures 5, 6:
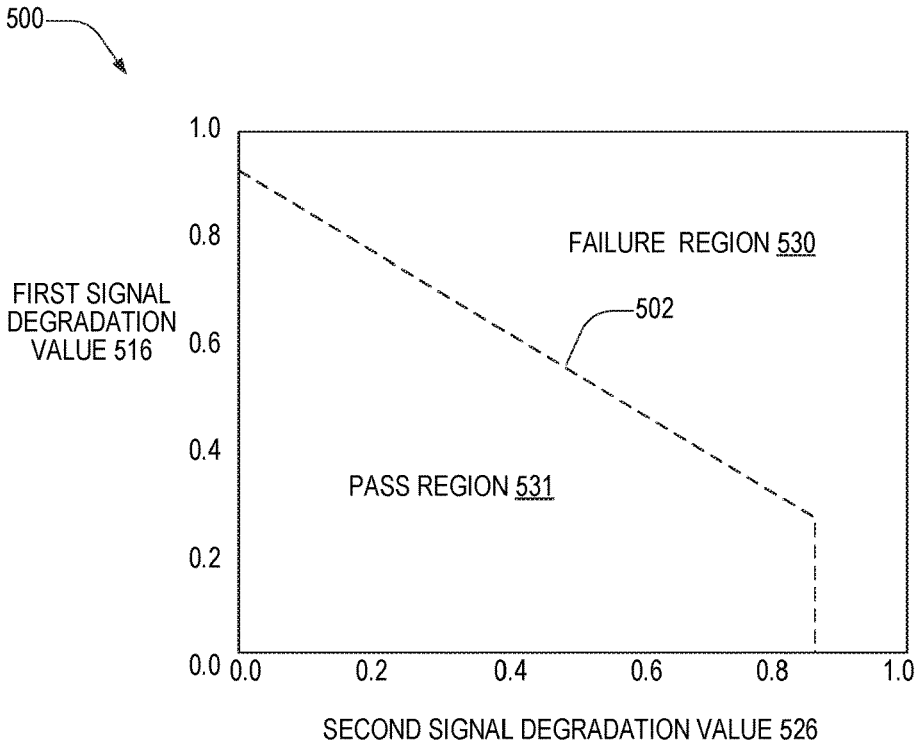
FIG. 5 illustrates a second smoke detector failure map stored in a memory of the smoke detector of FIG. 2, in an embodiment.
FIG. 6 illustrates a second example of a lookup table representing the failure map of FIG. 5.

FIG. 5 illustrates another embodiment of a smoke detector failure map, specifically disclosing a failure map 500. Failure map 500 includes a failure region 530, a pass region 531, and a boundary 502 therebetween, which are examples of failure region 330, pass region 331, and boundary 302, respectively. Failure map 500 was generated for a plurality of first and second signal degradation values 516 and 526, which are examples of first and second signal degradation values 316 and 326, respectively. In embodiments, first signal degradation values 516 correspond to degradation of first clean-air voltage 214 when first light source 210 is a blue LED. Second signal degradation values 526 correspond to degradation of second clean-air voltage 224 in response to near-IR light emitted by illuminator 208, e.g., via second light source 220.

FIG. 6 illustrates an example lookup table 600 representing a failure map 500 as an eleven-by-eleven array. Lookup table 600 is similar to lookup table 400 and is an example of lookup table 284. Boundary 502 is superimposed on lookup table 400 to denote the boundary between ones and zeros.

Figure 7:
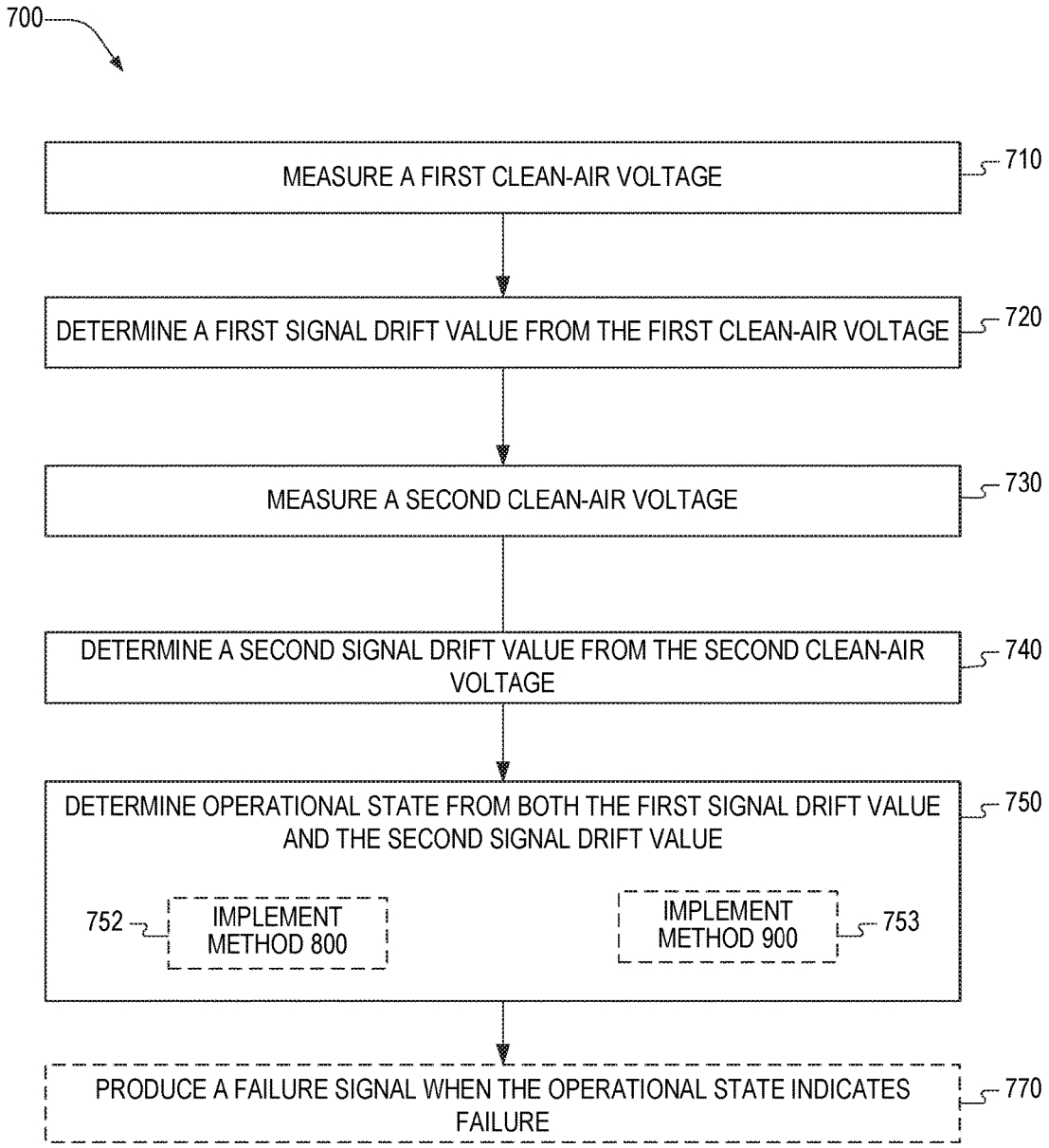
FIG. 7 is a flowchart illustrating a method for determining an operational state of the smoke detector of FIG. 1, in an embodiment.

FIG. 7 is a flowchart illustrating an example method 700 for determining an operational state of a smoke detector having an illuminator and a light sensor. Method 700 is, for example, implemented within one or more aspects of smoke detector 200 of FIG. 2.

In step 710, method 700 measures a first clean-air voltage, from the light sensor, in response to a first electromagnetic signal emitted by the illuminator. In an example of step 710, light sensor 230 of smoke detector 200 measures first clean-air voltage 214.

In step 720, method 700 determines a first signal drift value from the first clean-air voltage and a first reference voltage. In an example of step 720, signal drift evaluator 272 determines first signal drift value 216. Examples of first signal drift value 216 include any value of first signal degradation value 316, shown in FIG. 3, and any value of first signal degradation value 516, shown in FIG. 5.

In step 730, method 700 measures a second clean-air voltage, from the light sensor, in response to a first electromagnetic signal emitted by the illuminator. In an example of step 730, light sensor 230 measures second clean-air voltage 224.

In step 740, method 700 determines a second signal drift value from the second clean-air voltage and a second reference voltage. In an example of step 740, signal drift evaluator 272 determines second signal drift value 226. Examples of second signal drift value 226 include any value of second signal degradation value 326, shown in FIG. 3, and any value of second signal degradation value 526, shown in FIG. 5.

In step 750, method 700 determines the operational state from both the first signal drift value and the second signal drift value. In an example of step 750, failure checker 274 determines operational state 268 of smoke detector 200 from signal drift values 216 and 226 by comparing them to calibration data 280.

Method 700 may also include step 770, in which method 700 produces a failure signal when the smoke detector is in a failed or degraded operational state. In an example of step 770, failure monitor 240 produces failure signal 292 that is received by operational state indicator 290.

Figure 8:
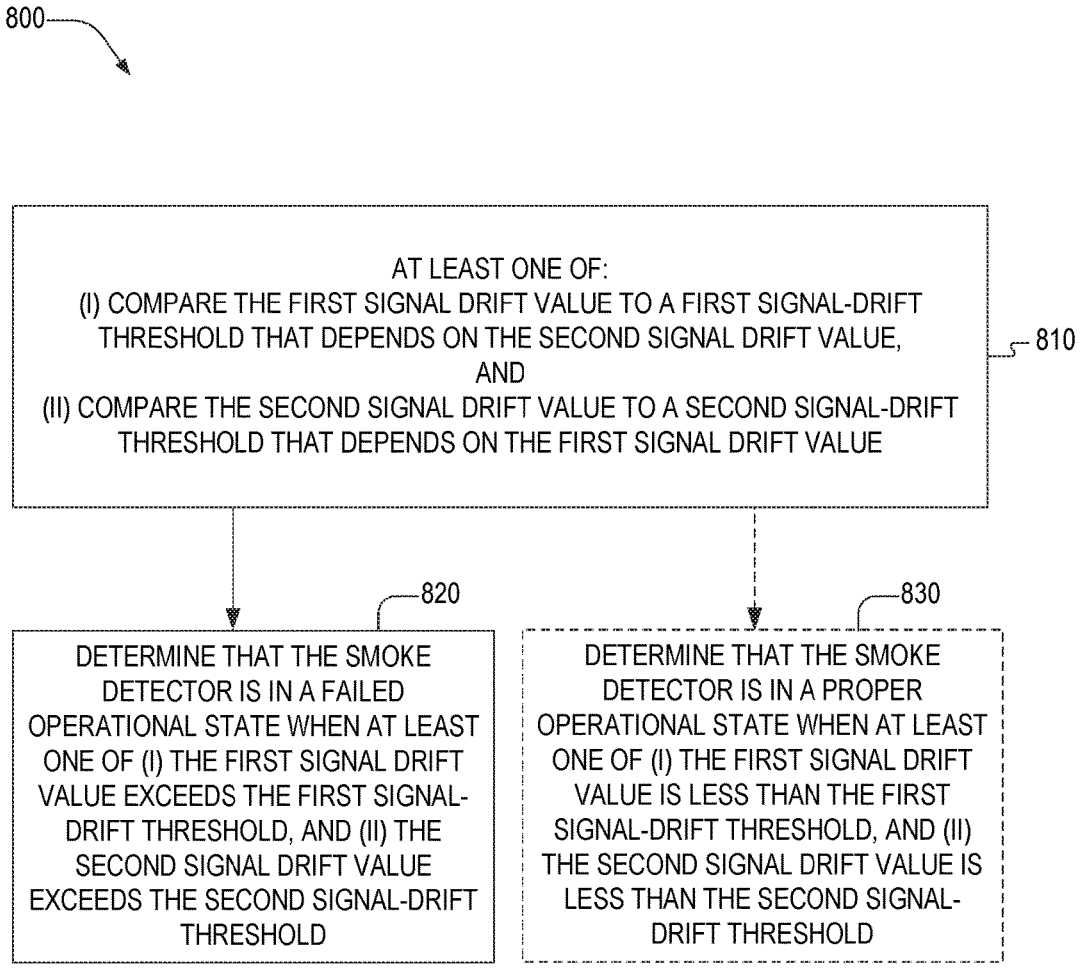
FIG. 8 is a flowchart illustrating a first method that may be implemented as part of the method of FIG. 7, in an embodiment.

Step 750 may include a step 752, in which method 700 implements a method 800. FIG. 8 is a flowchart illustrating method 800 for determining the operational state of the smoke detector from both the first signal drift value and the second signal drift value. Method 800 is, for example, implemented within one or more aspects of smoke detector 200 of FIG. 2.

In step 810, method 800 includes at least one of (i) comparing the first signal drift value to a first signal-drift threshold that depends on the second signal drift value, and (ii) comparing the second signal drift value to a second signal-drift threshold that depends on the first signal drift value. In step 820, method 800 determines that the smoke detector is in a failed or degraded operational state when at least one of (i) the first signal drift value exceeds the first signal-drift threshold, and (ii) the second signal drift value exceeds the second signal-drift threshold.

Method 800 may also include step 830. In step 830, method 800 determines that the smoke detector is in a proper operational state when at least one of (i) the first signal drift value is less than the first signal-drift threshold, and (ii) the second signal drift value is less than the second signal-drift threshold. In an embodiment, method 800 includes step 830 and does not include step 820. In a different embodiment, method 800 includes both steps 820 and 830. In a different embodiment, method 800 includes steps 820 and does not include step 830.

In the following examples of steps 810, 820, and 830 and referring back to FIGS. 2 and 3 in conjunction with FIG. 8, the first signal drift value is first signal drift value 216, and the second signal drift value is second signal drift value 226 stored in memory 260.

In a first example of steps 810 and 820, failure checker 274 compares first signal drift value 216 to the first signal-drift threshold, which is one of drift thresholds 286. The first signal-drift threshold is determined from boundary 302 of failure map 300 of FIG. 3. The first signal drift value equals 0.44 and the second signal drift value is equals 0.22, as indicated by horizontal dotted line 344 and vertical dotted line 322 respectively. For smoke detector 200 to operate properly at this second signal degradation value, second first signal drift value must not exceed 0.7, which is the value of boundary 302 when second signal degradation value 326 equals 0.22. Accordingly, for that particular second signal degradation value, the first signal-drift threshold is 0.7. In step 810 of this example, signal drift evaluator 272 compares the first signal drift value, 0.44, to the first signal-drift threshold, 0.7. In this first example, the first signal drift value is less than the first signal-drift threshold and, in step 830, failure checker 274 determines that smoke detector 200 is in a proper operational state, as illustrated by the intersection of lines 322 and 344 being in pass region 331.

A second example of steps 810 and 820 is similar to the first example in that the first and second signal drift values are the same as those of the first example: 0.44 and 0.22, respectively. This second example differs from the first example, however, as failure checker 274 compares the second signal drift value to the second signal-drift threshold, which is one of drift thresholds 286. The second signal-drift threshold is determined from boundary 302 of failure map 300 of FIG. 3. For smoke detector 200 to operate properly for the first signal degradation value (0.44), the second signal drift value must not exceed 0.6, which is the value of boundary 302 when first signal degradation value 326 equals 0.44. Accordingly, for that particular first signal degradation value, the second signal-drift threshold is 0.6. In step 810 of this example, signal drift evaluator 272 compares the second signal drift value, 0.22, to the second signal-drift threshold, 0.6. In this second example, the second signal drift value is less than the second signal-drift threshold and, in step 830, failure checker 274 determines that smoke detector 200 is in a proper operational state, as illustrated by the intersection of lines 322 and 344 being in pass region 331.

A third example of steps 810 and 820 combines the first and second examples. That is, step 810 of the third example includes step 810 of the first example and step 810 of the second example. That is, in the third example, failure checker 274 both (a) compares first signal drift value 216 to the first signal-drift threshold, which is one of drift thresholds 286, and (b) compares the second signal drift value to the second signal-drift threshold, which is one of drift thresholds 286.

In a fourth example of steps 810 and 820, the first signal-drift threshold is again determined from boundary 302 of failure map 300 of FIG. 3. The first signal drift value equals 0.44 and the second signal drift value is equals 0.67, as indicated by vertical dotted line 367. For smoke detector 200 to operate properly at this second signal degradation value, first signal degradation value 316 must not exceed 0.3, which is the value of boundary 302 when second signal degradation value 326 equals 0.67. Accordingly, the first signal-drift threshold is 0.3, which is one of drift thresholds 286. In step 810 of this example, signal drift evaluator 272 compares the first signal drift value, 0.44, to the first signal-drift threshold, 0.3. In this fourth example, the first signal drift value exceeds the first signal-drift threshold and, in step 820, failure checker 274 determines that smoke detector 200 is in a failed or degraded operational state, as illustrated by the intersection of lines 367 and 344 being in failure region 331.

A fifth example of steps 810 and 820 is similar to the fourth example in that the first and second signal drift values are the same as those of the fourth example: 0.44 and 0.67, respectively. This fifth example differs from the fourth example by comparing the second signal drift value to the second signal-drift threshold, which is one of drift thresholds 286. The second signal-drift threshold is determined from boundary 302 of failure map 300 of FIG. 3. For smoke detector 200 to operate properly for the first signal degradation value (0.44), the second signal drift value must not exceed 0.6, which is the value of boundary 302 when first signal degradation value 326 equals 0.44. Accordingly, the second signal-drift threshold is 0.6. In step 810 of this example, signal drift evaluator 272 compares the second signal drift value, 0.67, to the second signal-drift threshold, 0.6. In this fifth example, the second signal drift value exceeds the second signal-drift threshold. Accordingly, in step 820 of this example, failure checker 274 determines that smoke detector 200 is in a failed or degraded operational state, as illustrated by the intersection of lines 367 and 344 being in failure region 331.

A sixth example of steps 810 and 820 combines the fourth and fifth examples. That is, step 810 of the sixth example includes step 810 of the fourth example and step 810 of the fifth example. Similarly, step 820 of the sixth example includes step 820 of the fourth example and step 820 of the fifth example.

Figure 9:
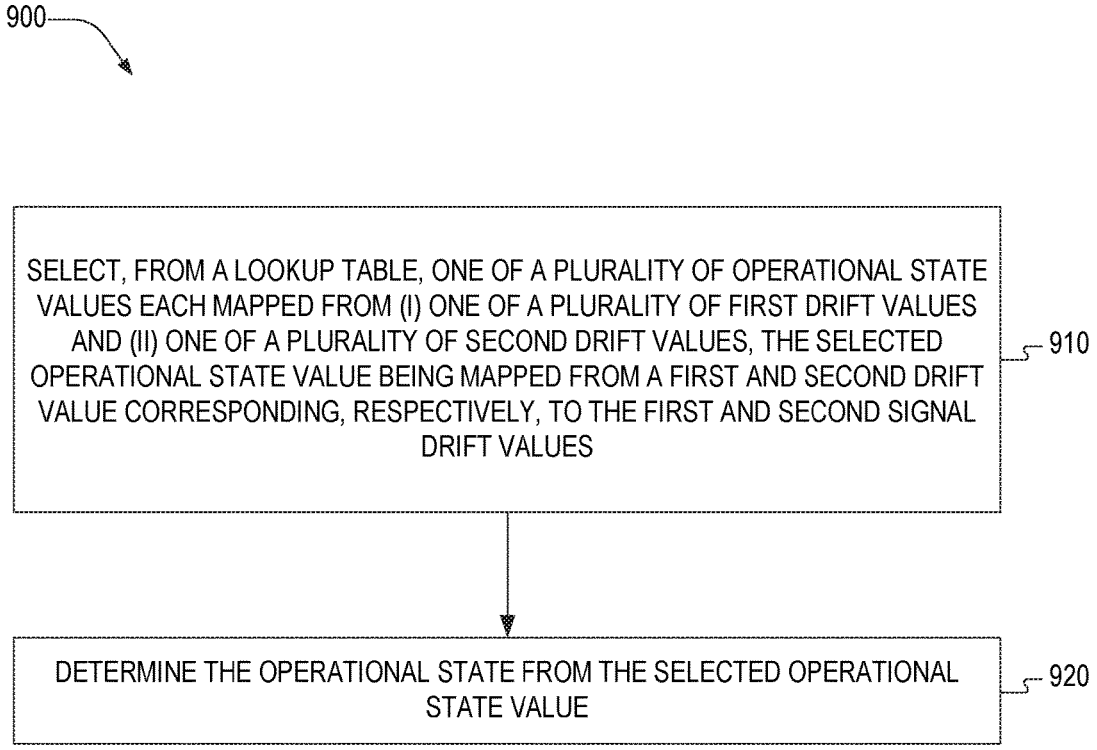
FIG. 9 is a flowchart illustrating a second method that may be implemented as part of the method of FIG. 7, in an embodiment.

In method 700, step 750 may include a step 753, in which method 700 implements a method 900. FIG. 9 is a flowchart illustrating method 900 for determining the operational state of the smoke detector from both the first signal drift value and the second signal drift value. Method 900 is, for example, implemented within one or more aspects of smoke detector 200 of FIG. 2.

In step 910, method 900 selects, from a lookup table, one of a plurality of operational state values each mapped from (i) one of a plurality of first drift values and (ii) one of a plurality of second drift values, the selected operational state value being mapped from a first and second drift value corresponding, respectively, to the first and second signal drift values. In step 920, method 900 determines the operational state from the selected operational state value.

In the following examples of steps 910 and 920 of method 900, the first signal drift value, the second signal drift value, and the look up table are, respectively, first signal drift value 216, second signal drift value 226, and lookup table 284.

In a first example of steps 910 and 920, lookup table 284 is lookup table 400, first signal drift value 216 equals 0.44, and second signal drift value 226 equals 0.22. These signal drift values map to operational state value 442 of lookup table 400. In step 910 of this first example, failure checker 274 selects the operational state value 442. In step 920 of this first example, failure checker 274 determines that the smoke detector 200 is in a proper operational state because operational state value 442 equals one.

In a second example of steps 910 and 920, lookup table 284 is lookup table 400, first signal drift value 216 equals 0.44, and second signal drift value 226 equals 0.67. These signal drift values map to operational state value 442 of lookup table 400. In step 910 of this first example, failure checker 274 selects the operational state value 447. In step 920 of this first example, failure checker 274 determines that the smoke detector 200 is in a failed or degraded operational state because operational state value 442 equals zero.

Combinations of Features

Features described above as well as those claimed below may be combined in various ways without departing from the scope hereof. The following examples illustrate some possible, non-limiting combinations:

(A1) denotes a method that determines an operational state of a smoke detector having an illuminator and a light sensor. The method includes steps of: (i) measuring a first clean-air voltage, from the light sensor, in response to a first electromagnetic signal emitted by the illuminator, (ii) determining a first signal drift value from the first clean-air voltage and a first reference voltage, (iii) measuring a second clean-air voltage, from the light sensor, in response to a second electromagnetic signal emitted by the illuminator, (iv) determining a second signal drift value from the second clean-air voltage and a second reference voltage, and (v) determining the operational state from both the first signal drift value and the second signal drift value.

(A2) The method denoted by (A1) may further include producing a failure signal when the smoke detector is in a degraded operational state.

(A3) In any method denoted by one of (A1) and (A2), the first electromagnetic signal has a first center wavelength, second electromagnetic signal may have a second center wavelength that exceeds the first center wavelength by at least twenty percent thereof.

(A4) In any method denoted by one of (A1) through (A3), the step of determining the operational state may include at least one of (i) comparing the first signal drift value to a first signal-drift threshold that depends on the second signal drift value, and (ii) comparing the second signal drift value to a second signal-drift threshold that depends on the first signal drift value. The step of determining the operational state may also include determining that the smoke detector is in a degraded operational state when at least one of (i) the first signal drift value exceeds the first signal-drift threshold, and (ii) the second signal drift value exceeds the second signal-drift threshold.

(A5) In any method denoted by (A4), the first signal-drift threshold may be a function of the second clean-air voltage, and the second signal-drift threshold may be a function of the first clean-air voltage.

(A6) In any method denoted by one of (A1) through (A5), the step of determining the operational state may include selecting, from a lookup table, one of a plurality of operational state values each mapped from (i) one of a plurality of first drift values and (ii) one of a plurality of second drift values, the selected operational state value being mapped from a first and second drift value corresponding, respectively, to the first and second signal drift values. The step of determining the operational state may also include determining the operational state from the selected operational state value.

(A7) In any method denoted by (A6), each of the plurality of operational state values may be one of (i) a first value indicating proper operation of the smoke detector and (ii) a second value indicating faulty operation of the smoke detector.

(A8) In any method denoted by one of (A6) and (A7), each of the plurality of operational state values may be one of a range of values, and the step of determining the operational state may include comparing the selected operational state value to a predetermined threshold value between a minimum and a maximum of the range of values.

(A9) In any method denoted by (A8), each value of the range of values may indicate a probability of smoke detector failure.

(B1) A smoke detector includes an illuminator, a light sensor, a memory, and a microprocessor. The illuminator is configured to emit a first electromagnetic signal having a first center wavelength and a second electromagnetic signal having a second center wavelength. The light sensor is configured to generate (a) a first clean-air voltage in response to receiving the first electromagnetic signal and (b) a second clean-air voltage in response to receiving the second electromagnetic signal. The memory stores non-transitory computer-readable instructions. The microprocessor is adapted to execute the instructions to: (i) determine a first signal drift value from the first clean-air voltage and a first reference voltage, (ii) determine a second signal drift value from the second clean-air voltage and a second reference voltage, and (iii) determine the operational state from both the first signal drift value and the second signal drift value.

(B2) In the smoke detector denoted by (B1), the first electromagnetic signal having a first center wavelength, and second electromagnetic signal may have a second center wavelength that exceeds the first center wavelength by at least twenty percent thereof.

(B3) In any smoke detector denoted by one of (B1) and (B2), the microprocessor may be further adapted to, when determining the operational state, execute the instructions to at least one of (i) compare the first signal drift value to a first signal-drift threshold that depends on the second signal drift value, and (ii) compare the second signal drift value to a second signal-drift threshold that depends on the first signal drift value. The microprocessor may be further adapted to determine that the smoke detector is in a degraded operational state when at least one of (i) the first signal drift value exceeds the first signal-drift threshold, and (ii) the second signal drift value exceeds the second signal-drift threshold.

(B4) In any smoke detector denoted by (B3) the first signal-drift threshold may be a function of the second clean-air voltage and the second signal-drift threshold may be a function of the first clean-air voltage.

(B5) In any smoke detector denoted by one of (B1) through (B4), the microprocessor may be further adapted to, when determining the operational state, execute the instructions to select, from a lookup table, one of a plurality of operational state values each mapped from (i) one of a plurality of first drift values and (ii) one of a plurality of second drift values, the selected operational state value being mapped from a first and second drift value corresponding, respectively, to the first and second signal drift values. The microprocessor may also be further adapted to, when determining the operational state, determine the operational state from the selected operational state value.

(B6) In any smoke detector denoted by (B5), each of the plurality of operational state values may be one of a range of values, and the step of determining the operational state may include comparing the selected operational state value to a predetermined threshold value between a minimum and a maximum of the range of values.

(B7) In any smoke detector denoted by (B6), each value of the range of values may indicate a probability of smoke detector failure.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A method for determining an operational state of a smoke detector having an illuminator and a light sensor, comprising:

measuring a first clean-air voltage indicative of a first intensity of a first electromagnetic signal detected by a first photodetector of the light sensor at a first center wavelength, wherein the illuminator comprises a first light source that emits light at the first center wavelength;

determining a first signal drift value from the first clean-air voltage and a first reference voltage for the first center wavelength;

measuring a second clean-air voltage indicative of a second intensity of a second electromagnetic signal detected by a second photodetector of the light sensor at a second center wavelength that exceeds the first center wavelength by at least twenty percent thereof, wherein the illuminator comprises a second light source that emits light at the second center wavelength;

determining a second signal drift value from the second clean-air voltage and a second reference voltage for the second center wavelength; and determining the operational state from both the first signal drift value of the first center wavelength and the second signal drift value of the second center wavelength, wherein determining the operational state comprises:

determining a signal-drift threshold based on the second signal drift value;

comparing the first signal drift value to the signal-drift threshold that was determined based on the second signal drift value to determine the operational state; and producing a failure signal when the smoke detector is in a degraded operational state.

2. The method of claim 1, wherein the signal-drift threshold is a function of the second clean-air voltage.

3. The method of claim 1, the step of determining the operational state comprising:

selecting, from a lookup table, one of a plurality of operational state values each mapped from (i) one of a plurality of first drift values and (ii) one of a plurality of second drift values, the selected operational state value being mapped from a first and second drift value corresponding, respectively, to the first and second signal drift values; and determining the operational state from the selected operational state value.

4. The method of claim 3, each of the plurality of operational state values being one of (i) a first value indicating proper operation of the smoke detector and (ii) a second value indicating faulty operation of the smoke detector.

5. The method of claim 3, each of the plurality of operational state values being one of a range of values, the step of determining the operational state comprising comparing the selected operational state value to a predetermined threshold value between a minimum and a maximum of the range of values.

6. A method for determining an operational state of a smoke detector having one or more illuminators and one or more light sensors, comprising:

measuring a first clean-air voltage, from the one or more light sensors, in response to a first electromagnetic signal emitted by the illuminator;

determining a first signal drift value from the first clean-air voltage and a first reference voltage;

measuring a second clean-air voltage, from the one or more light sensors, in response to a second electromagnetic signal emitted by the illuminator;

determining a second signal drift value from the second clean-air voltage and a second reference voltage; and determining the operational state from both the first signal drift value and the second signal drift value, comprising:

selecting, from a lookup table, one of a plurality of operational state values each mapped from (i) one of a plurality of first drift values and (ii) one of a plurality of second drift values, the selected operational state value being mapped from a first and second drift value corresponding, respectively, to the first and second signal drift values; and determining the operational state from the selected operational state value, wherein:

each of the plurality of operational state values being one of a range of values, the step of determining the operational state comprising comparing the selected operational state value to a predetermined threshold value between a minimum and a maximum of the range of values; and each value of the range of values indicating a probability of smoke detector failure.

7. A smoke detector comprising:

an illuminator configured to emit a first electromagnetic signal having a first center wavelength and a second electromagnetic signal having a second center wavelength different from the first center wavelength, wherein the second center wavelength exceeds the first center wavelength by at least twenty percent thereof;

a light sensor, comprising a first photodetector and a second photodetector, configured to generate (i) a first clean-air voltage indicative of a first intensity of the first electromagnetic signal measured using the first photodetector in response to receiving the first electromagnetic signal and (ii) a second clean-air voltage indicative of a second intensity of the second electromagnetic signal measured using the second photodetector in response to receiving the second electromagnetic signal;

a memory storing non-transitory computer-readable instructions;

a microprocessor adapted to execute the instructions to:

determine a first signal drift value from the first clean-air voltage and a first reference voltage;

determine a second signal drift value from the second clean-air voltage and a second reference voltage;

determine an operational state from both the first signal drift value and the second signal drift value, wherein the microprocessor adapted to execute the instructions to determine the operational state comprises the microprocessor adapted to execute the instructions to:

determine a signal-drift threshold based on the second signal drift value; and compare the first signal drift value to the signal-drift threshold that was determined based on the second signal drift value; and produce a failure signal when the smoke detector is in a degraded operational state.

8. The smoke detector of claim 7, the memory storing the first reference voltage and the second reference voltage.

9. The smoke detector of claim 7, at least one of:

the signal-drift threshold being a function of the second clean-air voltage.

10. The smoke detector of claim 7, the microprocessor being further adapted to, when determining the operational state, execute the instructions to:

select, from a lookup table, one of a plurality of operational state values each mapped from (i) one of a plurality of first drift values and (ii) one of a plurality of second drift values, the selected operational state value being mapped from a first and second drift value corresponding, respectively, to the first and second signal drift values; and determine the operational state from the selected operational state value.

11. The smoke detector of claim 10, each of the plurality of operational state values being one of a range of values, wherein determining the operational state further comprises comparing the selected operational state value to a predetermined threshold value between a minimum and a maximum of the range of values.

12. The smoke detector of claim 11, each value of the range of values indicating a probability of smoke detector failure.

* * * * *